United States Patent [19]

Buchner

[11] 4,222,427

[45] Sep. 16, 1980

[54] TRIM UNITS FOR VALANCES, DOORS AND THE LIKE

[76] Inventor: John Buchner, Burlington, Canada

[21] Appl. No.: 879,706

[22] Filed: Feb. 21, 1978

[51] Int. Cl.[2] ..... E06B 9/00

[52] U.S. Cl. ..... 160/19; 16/94 R

[58] Field of Search ..... 52/37, 39; 16/87 B, 16/94 R, 95 R, 93 D, 94 D, 95 D, 96 D; 160/38, 39; 49/410

[56] References Cited

U.S. PATENT DOCUMENTS

| | | | |
|---|---|---|---|
| 159,774 | 2/1875 | Sowle . | |
| 1,563,619 | 12/1925 | Goodrow . | |
| 1,752,025 | 3/1930 | Peterson | 16/95 R |
| 2,577,884 | 12/1951 | Garubo | 160/113 |
| 2,638,162 | 5/1953 | Heitlinger et al. | 160/38 |
| 2,876,504 | 3/1959 | Bennett et al. | 49/218 X |
| 2,894,571 | 7/1959 | Toti | 160/38 |
| 3,007,036 | 10/1961 | Mills, Jr. | 160/38 X |
| 3,297,075 | 1/1967 | Howell et al. | 160/19 |
| 3,435,876 | 4/1969 | Toti | 160/38 |
| 3,469,619 | 9/1969 | Barnett | 160/38 X |
| 3,650,071 | 3/1972 | Tanner | 49/411 |
| 3,699,610 | 10/1972 | Harby | 16/93 D X |
| 3,854,165 | 12/1974 | Haley | 49/410 X |
| 3,983,600 | 10/1976 | Smith | 16/95 R X |
| 3,987,515 | 10/1976 | Suuitie et al. | 16/95 R X |
| 4,014,072 | 3/1977 | Schumacher | 16/95 R |
| 4,079,770 | 3/1978 | Woodle | 160/39 X |

*Primary Examiner*—James A. Leppink

*Assistant Examiner*—Carl D. Friedman

*Attorney, Agent, or Firm*—Hirons, Rogers & Scott

[57] ABSTRACT

The invention provides a trim unit for use, for example, as a valance, or for application to sliding and bifold doors to screen the unsightly gap that usually is left between the bottom edge of the door supporting channel and the top edge of the door or doors. The unit consists of a U- or L-shaped base member having a first horizontal portion that is fastened in some convenient way to the ceiling or door header and a second vertical portion that extends downward when the unit is installed. A supplementary movable member is mounted on the second portion and can be adjusted in its vertical position thereon. Thus in the case of a door trim unit the supplementary member can be moved to screen the gap between the bottom edge of the channel and the top of the door without fouling the door as it is opened and closed. This gap cannot be predetermined and may be changed, e.g. when carpet is installed. In the case of a valance trim unit the supplementary member can be moved to the position that gives the desired vertical depth to the valance. The connection between the second vertical portion of the supplementary member may be, for example, by rivets or by nuts and bolts so that they are frictionally engaged together against relative movement. In other constructions struck-out parts of the base member frictionally engage the supplementary member, or the supplementary member is of U-shape and frictionally embraces the base member.

13 Claims, 11 Drawing Figures

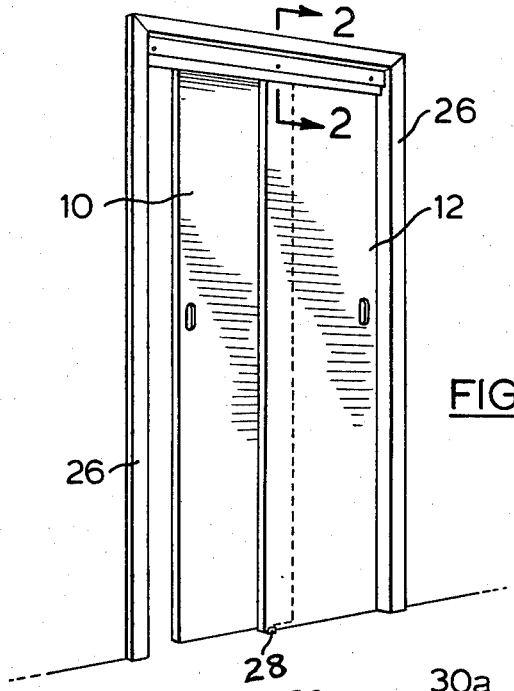
FIG. 1
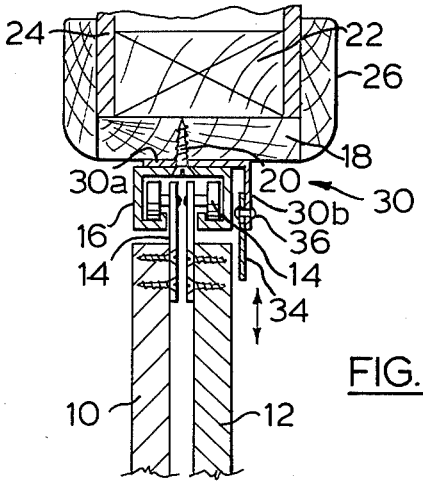
FIG. 2
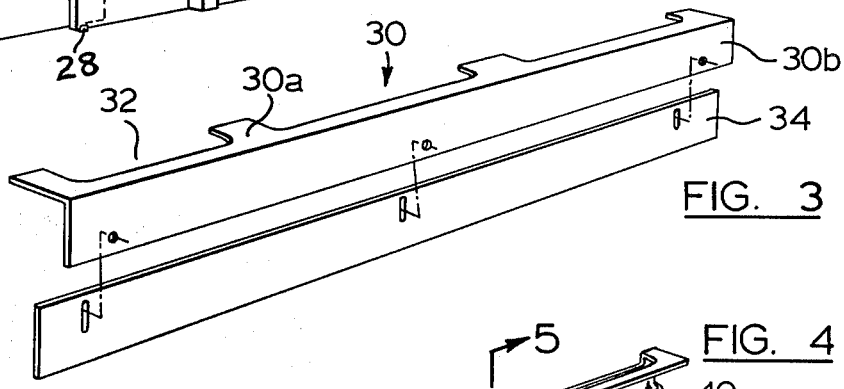
FIG. 3
FIG. 4
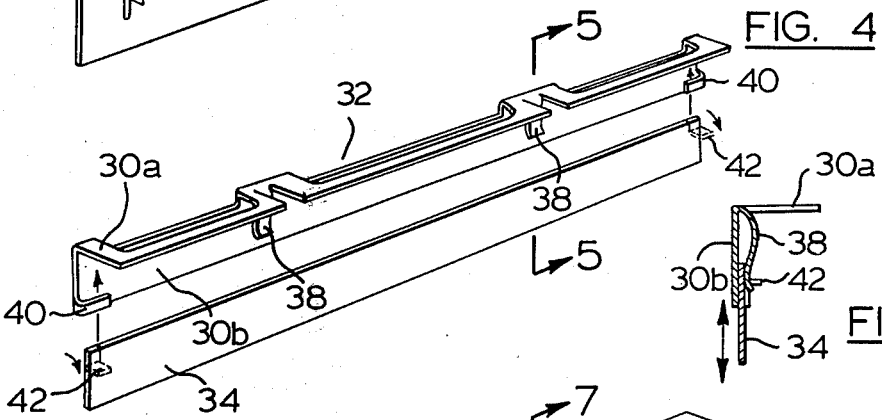
FIG 5
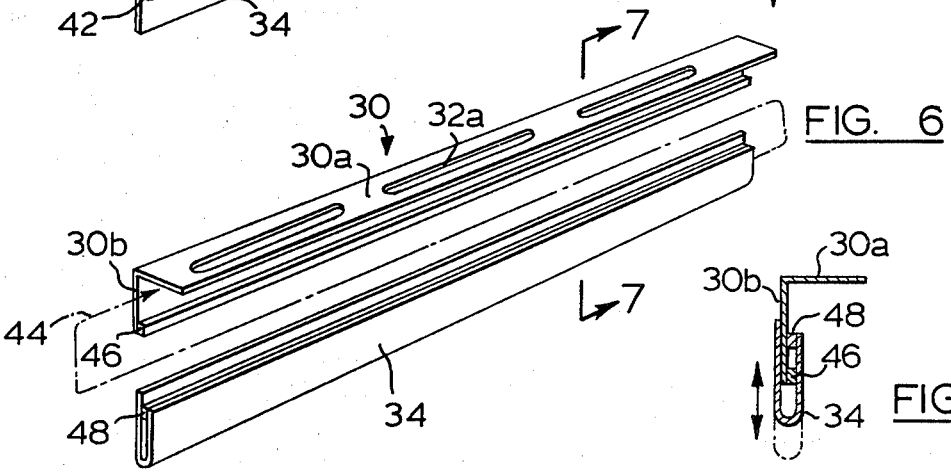
FIG. 6
FIG. 7

TRIM UNITS FOR VALANCES, DOORS AND THE LIKE

FIELD OF THE INVENTION

The present invention is concerned with improvements in or relating to trim units for valances, doors and the like.

REVIEW OF THE PRIOR ART

Valances are commonly used in buildings along walls, especially above windows, to provide a decorative heading for curtains and blinds. It is desired by builders and contractors to purchase valance units in prefabricated or kit form, but a severe problem exists in that the valance should be not only of predetermined length, but must also be of predetermined depth, depending upon its length and the room height, if an attractively-proportioned appearance is to be obtained.

The assembly and installation of folding and sliding doors in buildings has now become virtually completely standardized. Thus, usually a channel-section track is fastened to the door frame header with its open side facing downward, and the door then mounted by this track to move across the door opening. A trim strip is usually fastened to the front of the channel to conceal it. The door opening is always made somewhat taller than necessary, so as to be sure that the door can be installed and will move freely, with the result that there is always a gap of unpredictable height left between the bottom edge of the channel and the top of the door.

DEFINITION OF THE INVENTION

It is therefore an object of the invention to provide a new trim unit for use with valances, doors and the like.

It is a more specific object to provide a new trim unit for use with valances, doors and the like and adapted in the case of a valance unit to be readily adjustable in vertical height, and in the case of a door unit to be readily adjustable after installation to cover the gap between the door and its supporting channel.

In accordance with the present invention therefore there is provided a new trim for valances, doors and the like comprising:

a base member having a first horizontal member adapted to be mounted on a generally horizontal surface of the building structure for support of the base member;

a second vertical member depending from the base member to extend downwards from the base member when the unit is mounted on the building structure and having a front surface constituting a trim surface of the base trim member; and a supplementary trim member mounted on the said second vertical member for vertical movement when the unit is mounted on the building structure to expose the required amount of the front trim surface of the base trim member and to adjust the vertical height of the combined vertical and supplementary members.

DESCRIPTION OF THE DRAWINGS

Particular preferred embodiments of the invention will now be described, by way of example, with reference to the accompanying diagrammatic drawings wherein:

FIG. 1 is a general perspective view of a sliding closet door having a door trim unit of the invention employed therewith, FIG. 2 is a section taken on the line 2—2 of FIG. 1, FIG. 3 is an exploded perspective view of the first embodiment of FIGS. 1 and 2, viewed from the front, FIG. 4 is an exploded perspective view of a second embodiment viewed from the rear, FIG. 5 is a section taken on the line 5—5 of FIG. 4, FIG. 6 is a similar view to FIG. 4 of a third embodiment, FIG. 7 is a section taken on the line 7—7 of FIG. 6.

DESCRIPTION OF THE PREFERRED EMBODIMENTS

Figure 8:
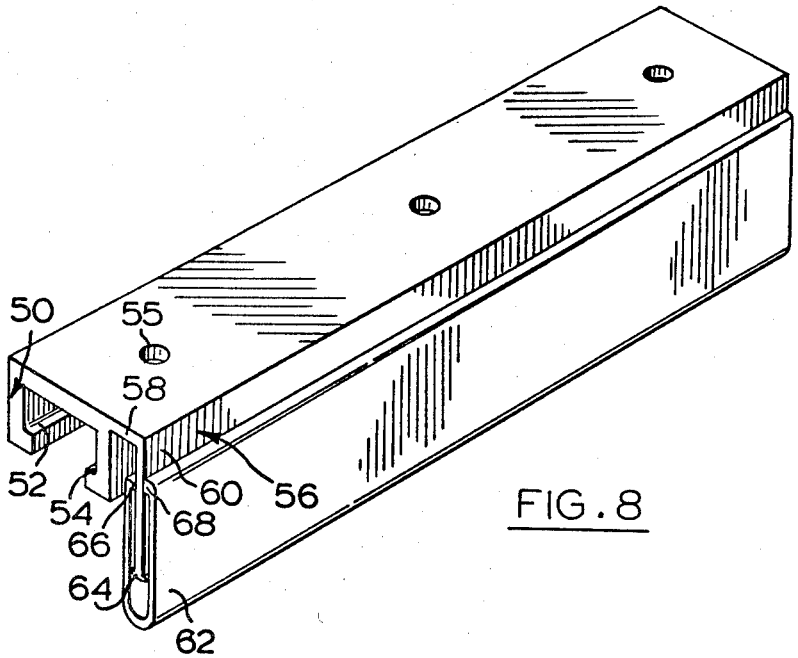
FIG. 8 is a perspective view of a door trim unit which is a further embodiment in which a door support channel is formed integral with the unit.

The sliding door particularly illustrated in FIGS. 1 and 2 as an example for the use therewith of a door trim unit of the invention is of conventional form, consisting of two doors 10 and 12 suspended by hangers 14 to ride from a channel member 16 fixed to a horizontal wooden door header member 18 by screws such as 20. The header is in turn fixed to a horizontal cross member 22 to which is nailed sheathing 24; the frame is completed by trim moulding 26. The bottom edges of the doors are guided in their sliding movement by guides 28 fixed to the floor. The invention is however also applicable to other types of door, such as the usual concertina and bi-fold types, as will be apparent to those skilled in the art from the description herein.

The first embodiment illustrated by FIGS. 1 to 3 comprising a door trim unit of the present invention is specifically intended for use with a door already installed and/or with the conventional already available form of channel member 16, and therefore consists of an L-shaped base trim member 30 having a first horizontal member **30*a* which is adapted to be inserted between the base of the channel member 16 and the header member 18. Thus, in a new construction the trim member is placed in position and the channel screwed against it, the arm 30*a* having elongated bights 32 therein for the passage of the screws 20. The unit can also readily be applied to an established installation by loosening the screws holding the channel member until the member 30*a* can be inserted in the resultant space, and then retightening the screws. The vertical second arm member 30*b* of the base trim member extends vertically downwards in front of the channel 16 and screens it from view. The bottom edge of the arm 30*b*** will usually be in about the neighbourhood of the bottom edge of the channel.

The unit is completed by a supplementary trim member 34 mounted on the vertical second arm for adjustable vertical movement, so that it can be moved vertically downward, between two extreme positions dictated by its mode of fastening to the base member, into a selectable position in which it just screens the gap between the bottom edge of the channel 16 and the top edges of the doors 10 and 12.

In the embodiment of FIGS. 1 to 3 the fastening between the base and supplementary members is illustrated as by rivets 34 which extend through vertically elongated slots in the supplementary member, the rivets fastening the members together sufficiently tightly for them to move relatively to one another with difficulty owing to the friction between them. Bolts and nuts or any equivalent fastening could be used instead. At least the surfaces of the base and supplementary trim members which face the front are provided with any desired suitable surface finish, such as woodgrain, or are treated to render them readily paintable.

In the embodiment of FIGS. 4 and 5 parts 38 are struck out of the arm 30 and bent downwards to frictionally engage the rear face of the supplementary member. Additional end parts 40 may be provided for the same purpose, and in addition these parts 40 may engage struck out portions 42 of the supplementary member to determine the lowest position to which the supplementary member can be moved.

In the embodiment of FIGS. 6 and 7 the supplementary member 34 is of U-section and embraces the downwardly-extending arm member **30*b*, being slid onto the base member in the manner illustrated by the arrow 44, and being frictionally engaged therewith. The two members are provided with respective cooperating elongated stop members 46 and 48, along their rear lower edges and the adjacent upper edge respectively, which determine the lowermost position of the supplementary member. Elongated slots 32*a* are used instead of bights for passage for the fastening screws 20**.

In the application particularly illustrated, namely as a door trim unit used with sliding doors, the position in which the supplementary member is placed is not particularly critical, since the doors move parallel thereto, and any position in which the gap is completely screened is satisfactory. In the case of the popular bifold doors (or concertina doors) the position is much more critical, and the lowest position is chosen that will screen the gap as completely as possible without fouling the doors as they are opened and closed. The door trim unit of the invention is of particular value in situations where the height of the door may need to be changed. For example, if carpet is installed through the doorway then the door must be raised; the position of the supplementary member is then very readily altered to take account of the altered height of the gap.

Another embodiment of the invention illustrated by FIG. 8 comprises a combined trim unit and channel member. Such an embodiment is of particular benefit in new constructions, where doors or similar structures are being installed for the first time. The combined channel member and trim unit is simple and easy to install, in a single operation, and can be manufactured from metal or plastic material by a rapid and economical moulding or extrusion operation to produce a functional yet attractive product. The channel member is rigidly fixed to, and preferably is made integral with, the first horizontal member of the trim unit, apertures being provided in the base of the channel member for securing it to a door header member or similar external structure.

Thus, an elongated channel member 50 is provided which in operative position has its open side presented downwardly, the channel edges being provided with a pair of respective inturned lower edges 52, 54 providing tracks on which rollers or door suspension members may run. Holes 56 are provided in the channel base for the reception of mounting screws. Portion 56 of the member provides the first horizontal member 58, which is therefore integral with the channel member 50 and forms a continuation of the top surface thereof, while the second vertical member is constituted by an integral depending second member 60 which extends in front of the channel member when the unit is mounted in operative position. The unit is completed by a generally U-sectioned supplementary trim member 62, similar to that described and illustrated in connection with FIGS. 6 and 7. The supplementary trim member 62 embraces and frictionally engages the lower end of the depending second arm 60, so as to be vertically adjustable and positionable with respect thereto, to cover gaps of different heights between the tops of the associated doors and the bottom of channel member 50, by which the doors are mounted. A stop member 64 extends outwardly from the bottom edge of the depending second member 60 along the full length thereof, and cooperates with inturned formations 66, 68 extending along the top edges of the supplementary trim member 62, to determine the lowermost position of the supplementary trim member 62, and also to enhance the frictional engagement.

It will of course be appreciated that any other configuration of combined channel member and trim unit can be adopted and, for example, the channel member need not be of generally rectangular internal section as illustrated, as long as it provides the necessary upwardly presented running surface or surfaces for door hangers. It can for example take the form of a solid or tubular elongated bar with outwardly protruding side ledges forming the support surfaces for the door suspension members. In similar manner, other configurations of supplementary trim member and depending second arm member can be adopted, for example as previously described herein and illustrated in FIGS. 3–7.

Figure 9:
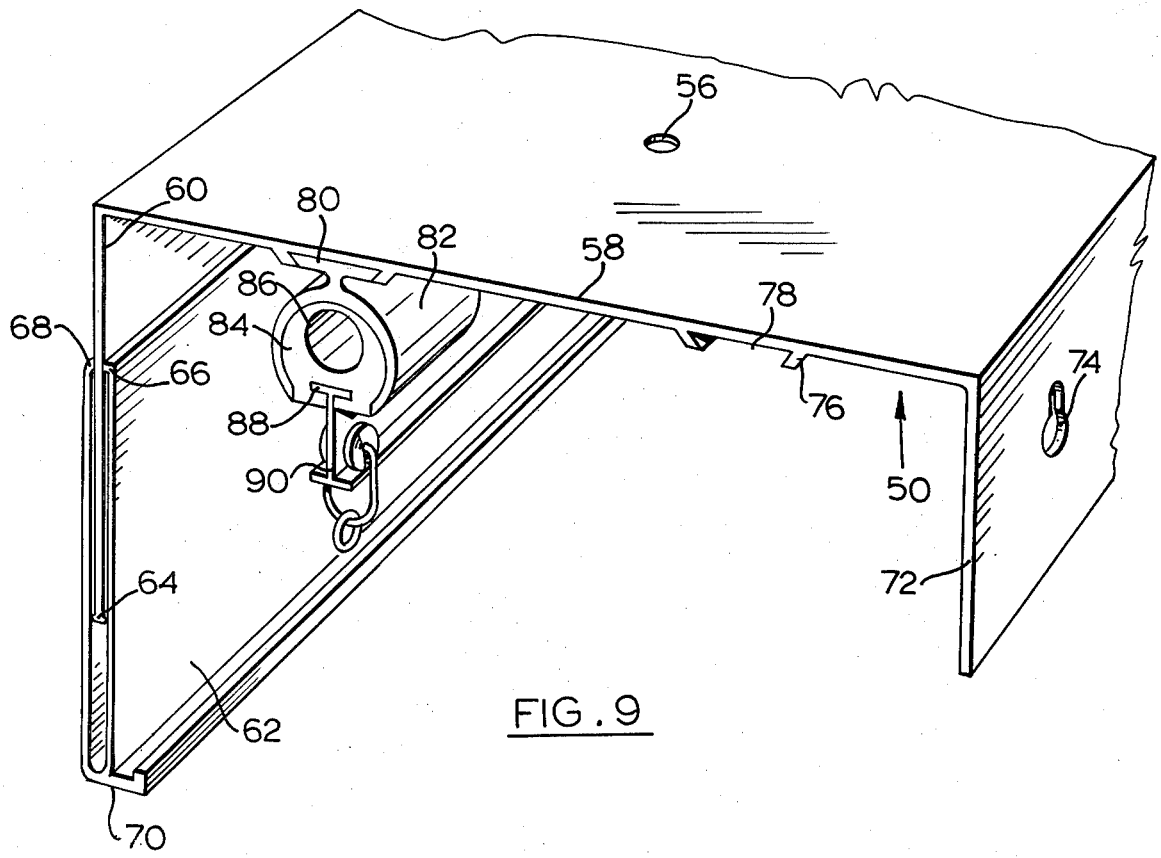
FIG. 9 is a perspective view of a valance unit which is a yet further embodiment of the invention.
Figure 11:
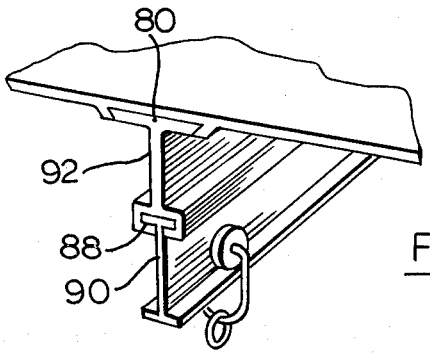
FIG. 11 is a perspective view of a curtain runner support unit for use with the embodiment of FIG. 9.
Figure 10:
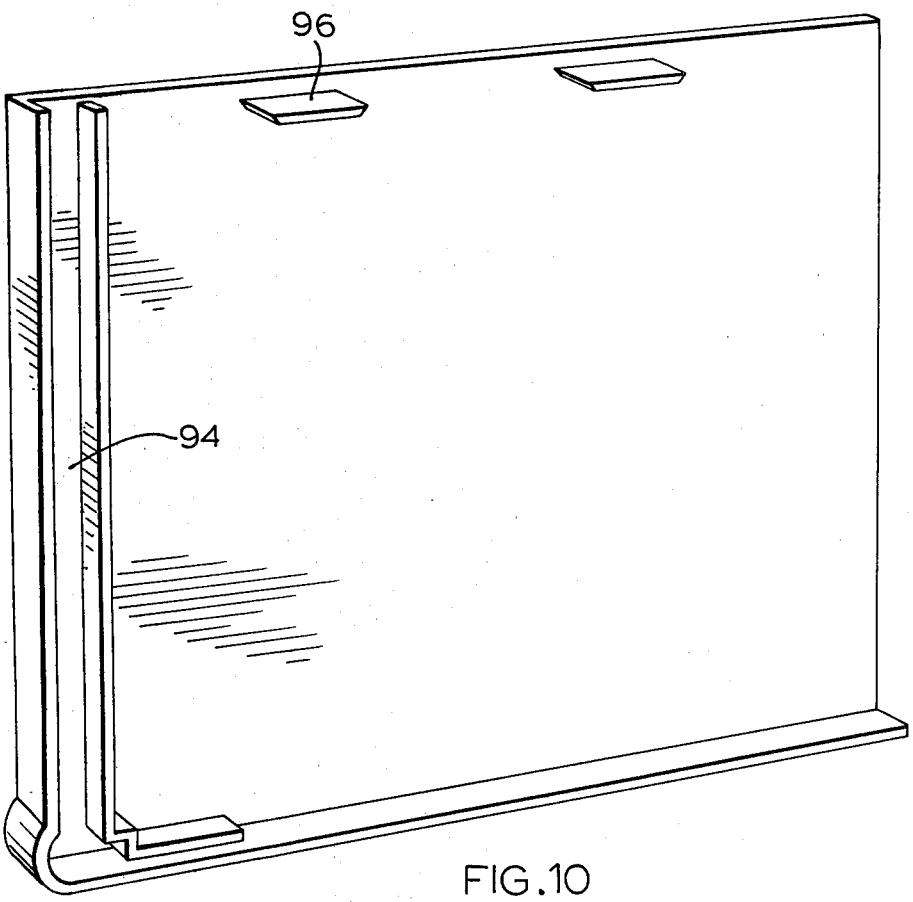
FIG. 10 is a perspective view of an end plate for the unit of FIG. 9.

Referring now to FIGS. 9 to 11, there are illustrated therein other embodiments of the invention comprising a valance trim unit adapted to support a blind or curtain suspension system and to hide it from view. Valances are commonly used along walls of buildings, particularly in front of the windows, where it is desired to provide some added decorative effect, such as the concealment of the wall/ceiling junction, suspension of plants, curtains or blinds, mounting of concealed strip lighting, etc. The length of valance to be employed will of course depend upon the nature of the installation but, almost as importantly, it is necessary to select carefully the height of the valance if the maximum decorative effect is to be obtained, and it is not always possible to determine in advance the height that will give the desired effect. With a valance trim unit of the invention it is possible to install the valance and then adjust the height until the desired appearance is obtained. Parts which are similar to the embodiment of FIG. 8 will be given the same reference number.

Thus, the elongated valance channel member 59 has a first horizontal member 58 constituting the base of the channel, provided with holes 56 for the reception of mounting screws by which it can be fastened to the ceiling of a building structure. The depending second member 60 carries the U-shaped supplementary trim member 62 which embraces and frictionally engages the depending member. The two members are provided with respective cooperating stop members 64, 66 and 68 as with the embodiment of FIG. 8. The lower end of the supplementary member 62 is provided with an inturned edge 70 providing an inside support channel. The other wall 72 of the channel depends parallel to the wall member 60 and is provided with apertures such as 74 for fastening screws.

The valance unit is provided with integral support means for plants, curtains etc., consisting of at least one pair of downwardly and inwardly extending integrally moulded protrusions 76 that extend the full length of the valance unit. The protrusions thus form between them a tapered or wedge shaped channel 78 into which can be slid rod-support hanger members comprising a wedge-shaped portion 80 of complementary shape to the wedge-shaped channel joined to a part-cylindrical portion 82 that will receive a rod-shaped curtain support. If the curtain etc., is to be supported from a smaller diameter rod then an adaptor member 84 having a passage 86 of appropriate size is slipped into the portion 80.

The adaptor member also is provided with a T-section slot 88 adapted to receive the upper run of a length of conventional I-section support beam 90. Alternatively, the adaptor member 92 illustrated by FIG. 11 can be employed, which is adapted to receive only I-section support beams. The valance unit can be produced by extrusion and cut to standard lengths from which the desired length can be cut. If the valance is free-standing its ends are closed by an end plate such as is illustrated in FIG. 10, having a channel 94 which embraces the adjacent edge of the unit and projections 96 which can be inserted into the wedge-shaped channels 77, different heights of plate being required to accommodate different positions of the supplementary trim member.

What I claim is:

1. A trim unit for valances, doors and the like for mounting on a building structure, the unit comprising:

a unitary elongated base trim member having a first horizontal member adapted to be mounted on a generally horizontal surface of the building structure for support of the base member and to extend across the doors and the like; and having a second, vertical member depending from the base member to extend downwards from the base member when the unit is mounted on the building structure and having a front surface constituting a part of the trim surface of the trim unit as a whole; and an elongated, unitary supplementary trim member mounted on the said second vertical member and having a front surface to constitute an additional front trim surface of the unit as a whole, and of generally similar length to said base trim member and mounted for vertical movement when the unit is mounted on the building structure to expose the required amount of front trim surface of the base trim member and thereby to adjust the vertical height of the combined front trim surfaces of the vertical and supplementary members.

2. A trim unit is claimed in claim 1, wherein the supplementary member is of U cross-section embracing the said second vertical member and frictionally engaged therewith to hold it in a position relative thereto in which it is placed.

3. A trim unit as claimed in claim 2, wherein the second and supplementary trim members are provided with respective cooperating projecting members determining the lowermost extreme position of the supplementary trim member.

4. A trim unit as claimed in claim 3, wherein the lower edge of the second member is provided with two outwardly-extending projections and the upper edge of the supplementary trim member is provided with two inwardly-extending projections engageable with the second member projections to determine the lowermost extreme positions of the supplementary member.

5. A trim unit as claimed in claim 1, and for use in connection with a door for mounting to the door frame by a door support member fastened to a door frame header, the unit comprising:

a door support member integral with the said first horizontal member and providing at least one track for receiving door suspension members;

the said vertical second member depending from the first member to extend in front of the door support member.

6. A trim unit as claimed in claim 1, and for use in connection with a door for mounting to the door frame by a door support member fastened to a door frame header, the unit comprising:

a channel section door support member integral with the said first horizontal member and providing a pair of spaced parallel tracks for receiving door suspension members, the said vertical second member depending from the first member to extend in front of the door support member.

7. A trim unit as claimed in claim 1 wherein the said base member is of L cross-section with the said first horizontal member adapted to be inserted between the base of the door supporting channel member and the door frame for support of the trim member therefrom.

8. A trim unit as claimed in claim 1 and for use as a valance, the unit comprising mounting means at the undersurface of the said first horizontal member for receiving support means for a curtain or the like.

9. A trim unit as claimed in claim 8, wherein the said mounting means comprise integral projections from the said first horizontal member undersurface providing a channel for sliding reception of said support means.

10. A trim unit as claimed in claim 8, wherein said support means comprise a member having a portion slidably received between the said projections and another portion having an aperture therein for reception of a curtain rod.

11. A trim unit as claimed in claim 8, wherein said support means comprise a member having a portion slidably received between the said projections and another portion having an aperture therein for reception of an I-section curtain support beam.

12. A trim unit as claimed in claim 1, wherein the supplementary member is riveted to the second vertical member and is held in friction contact with the member by the rivets to hold the supplementary member in a position in which it has been placed.

13. A trim unit as claimed in claim 1, wherein the said first horizontal member is provided with struck-out downwardly-extending portions frictionally engaging the rear face of the supplementary member to hold the supplementary member in a position in which it has been placed.

* * * * *